US005740663A

United States Patent [19]

de Haan et al.

[11] Patent Number: 5,740,663

[45] Date of Patent: Apr. 21, 1998

[54] INSERTING APPARATUS

[75] Inventors: Hendrik Andries de Haan, Bergum; Christiaan Antoon Munneke, Surhuisterveen, both of Netherlands

[73] Assignee: Hadewe B.V., Drachten, Netherlands

[21] Appl. No.: 775,026

[22] Filed: Dec. 27, 1996

[30] Foreign Application Priority Data

Dec. 29, 1995 [NL] Netherlands ..... 1002001

[51] Int. Cl.[6] ..... B65B 43/26; B65B 43/42; B65B 39/00

[52] U.S. Cl. ..... 53/569; 53/284.3

[58] Field of Search ..... 53/569, 284.3, 53/381.5, 381.7, 389.4, 389.5, 255

[56] References Cited

U.S. PATENT DOCUMENTS

| | | | |
|---|---|---|---|
| 3,936,993 | 2/1976 | Dorer | 53/284.3 |
| 4,852,334 | 8/1989 | Auerbach | 53/569 |
| 4,888,938 | 12/1989 | Auerbach | 53/284.3 X |
| 4,962,623 | 10/1990 | Francisco | 53/284.3 X |
| 5,081,825 | 1/1992 | Mrozinski | 53/284.3 X |
| 5,327,705 | 7/1994 | DeFigueriedo | 53/284.3 X |
| 5,388,388 | 2/1995 | Belec et al. | 53/460 |
| 5,447,015 | 9/1995 | Belec et al. | 53/284.3 X |
| 5,630,312 | 5/1997 | Ballard et al. | 53/284.3 X |
| 5,642,598 | 7/1997 | Cannaverde | 53/284.3 |

FOREIGN PATENT DOCUMENTS

| | | |
|---|---|---|
| 29 13 428 | 10/1980 | Germany . |
| 2 283 479 | 5/1995 | United Kingdom . |

*Primary Examiner*—Horace M. Culver
*Attorney, Agent, or Firm*—Burns, Doane, Swecker & Mathis, L.L.P.

[57] ABSTRACT

An inserting apparatus comprises an envelope holder for holding an envelope in a filling position, a document feed path and a flap holder for holding a flap of an envelope in an open position. On the side of the document supply path where the flap holder is also located, the most downstream roller is formed by a return pulley of a conveyor belt. Owing to a conveyor belt being trained over the most downstream roller on that side of the document feed path where the flap holder is also located, a small roller can be used without this leading to run-in problems. The documents are moreover forcefully advanced at the end of the document feed path into a nip between two rollers.

11 Claims, 1 Drawing Sheet

INSERTING APPARATUS

FIELD AND BACKGROUND OF THE INVENTION

This invention relates to an inserting apparatus with an envelope holder for holding an envelope in or against a particular surface, a flap holder for holding in an open position a flap of an envelope being held in the envelope holder, and a document feed path, of which most downstream operative transport elements are formed by an extreme downstream conveyor roller on a first side of the document feed path proximal to the flap holder, which also constitutes the extreme downstream guide on the first side of the document feed path proximal to the flap holder, and an opposite, circulating conveying element, defining a nip together with the aforementioned downstream conveyor roller, which constitutes the extreme downstream conveying element on a second side of the document feed path.

Such an inserting apparatus is known from U.S. Pat. No. 4,852,334. U.S. Pat. No. 4,888,938 also discloses such an apparatus.

Such inserting apparatuses are intended for the insertion into an envelope of documents to be mailed in that envelope and are generally further equipped with facilities for closing the flap of the envelope.

In the mechanical insertion of documents into an envelope, it is important that all documents are moved beyond the fold line which separates the flap from the rest of the envelope. If this is not the case, documents will be folded or damaged during closure of the flap and the closure of the flap will be impeded or prevented.

In order that the documents to be inserted into an envelope be moved as reliably as possible beyond the fold edge bounding the flap in spite of the frictional resistance between the envelope and those documents, in the known apparatuses the document feed path includes guide and transport means very close to the envelope holder, so that the documents can be driven to a point very far into the envelope.

On the side of the flap holder there is little space available for these guide and transport means, because the angle between the document feed path and the envelope, on account of the limited flexibility of the envelope supplied via the flap holder, has to be fairly acute. In order to yet enable the most downstream nip of the document feed path to be provided at a point far downstream, in the known apparatuses the most downstream roller of the document feed path on the side of the flap holder, which at the same time constitutes the most downstream guide on that side of the document feed path, is therefore designed as a free-running press-on roller with, relatively, a very small diameter.

However, a drawback of this construction is that the press-on roller does not drive any documents on the side of a stack to be inserted remote from the flap holder but only presses on them. In order to generate such friction that the friction between the stacked documents reliably overcomes the friction between the documents and the envelope, the press-on force with which this free-running roller is pressed against the passing documents must therefore be fairly large.

The large press-on force and the small diameter of the free-running roller, however, render more difficult the run-in of documents gathered into a stack. This applies the more so according as the stack of documents is thicker. The press-on force to be chosen will therefore have to be a compromise between, on the one hand, the desire to increase the press-on force so as to generate sufficient friction within the stacks and, on the other, the desire to lower the press-on force so as to prevent problems during the infeed of the documents.

U.S. Pat. No. 5,388,388 discloses an inserting apparatus where the downstream end of the document feed path on the side of the flap holder is constituted by a stationary document guide over which the documents are guided. To this document guide, on the upstream side thereof, connects a circulating conveyor belt. The downstream end of this conveyor belt is located further from the envelope holder than the downstream end of an opposite conveyor belt located on the side of the document feed path remote from the flap holder. In order to be able to effect displacement of documents to be inserted into an envelope over the guide until the documents are disposed for the greater part in the envelope, the apparatus is provided with most downstream operative transport elements in the form of a separate drive with circulating fingers on the side of the document feed path remote from the flap holder. This construction is complicated and requires a fast, accurate control and drive.

British patent application 2,283,479 and German patent application 29 13 428 also disclose inserting apparatuses which are equipped with separate transport elements operative downstream of opposite conveyor belts, in the form of circulating transport fingers. In operation, these most downstream operative transport elements of the document feed path press documents to be inserted further into an envelope, after they have come clear of the more upstream opposite conveyor belts of the document feed path.

SUMMARY OF THE INVENTION

The object of the invention is to provide an inserting apparatus by which stacks of documents—without additional provisions for the further drive, downstream of the document feed path, of displacements of the documents to be inserted into envelopes—can be reliably inserted into envelopes, without this leading to problems during the lead-in of thicker stacks of documents.

This object is realized according to the invention in that in an inserting apparatus of the type initially described the extreme downstream roller on the first side of the document feed path is designed as a downstream return pulley of a circulating conveyor belt.

Owing to the feature that in the apparatus according to the invention the most downstream guide of the document feed path on the side of the flap holder is constituted by a conveyor belt trained over a roller, a relatively small roller can be used, without this leading to run-in problems, so that in a simple manner a reliable drive of the documents on the side of the flap holder to a point very close to an envelope held in the envelope holder can be obtained. Moreover, the press-on force can be chosen to be relatively high without this leading to run-in problems.

Preferably, the most downstream roller on the side of the document feed path proximal to the flap holder and the opposite roller form a nip, between which the documents are forcefully clamped, so that even on the last, trailing part of the documents to be inserted into an envelope a large frictional force can be exerted and the exerted press-on force does not result in a dip in the document feed path.

Further aspects, embodiments and advantages of the invention are further illustrated and explained on the basis of an exemplary embodiment, with reference to the drawings.

BRIEF DESCRIPTION OF THE DRAWINGS

The drawing shows a schematized cutaway side elevation of an apparatus according to an exemplary embodiment of the invention which is presently preferred most.

DETAILED DESCRIPTION

Figure 1:
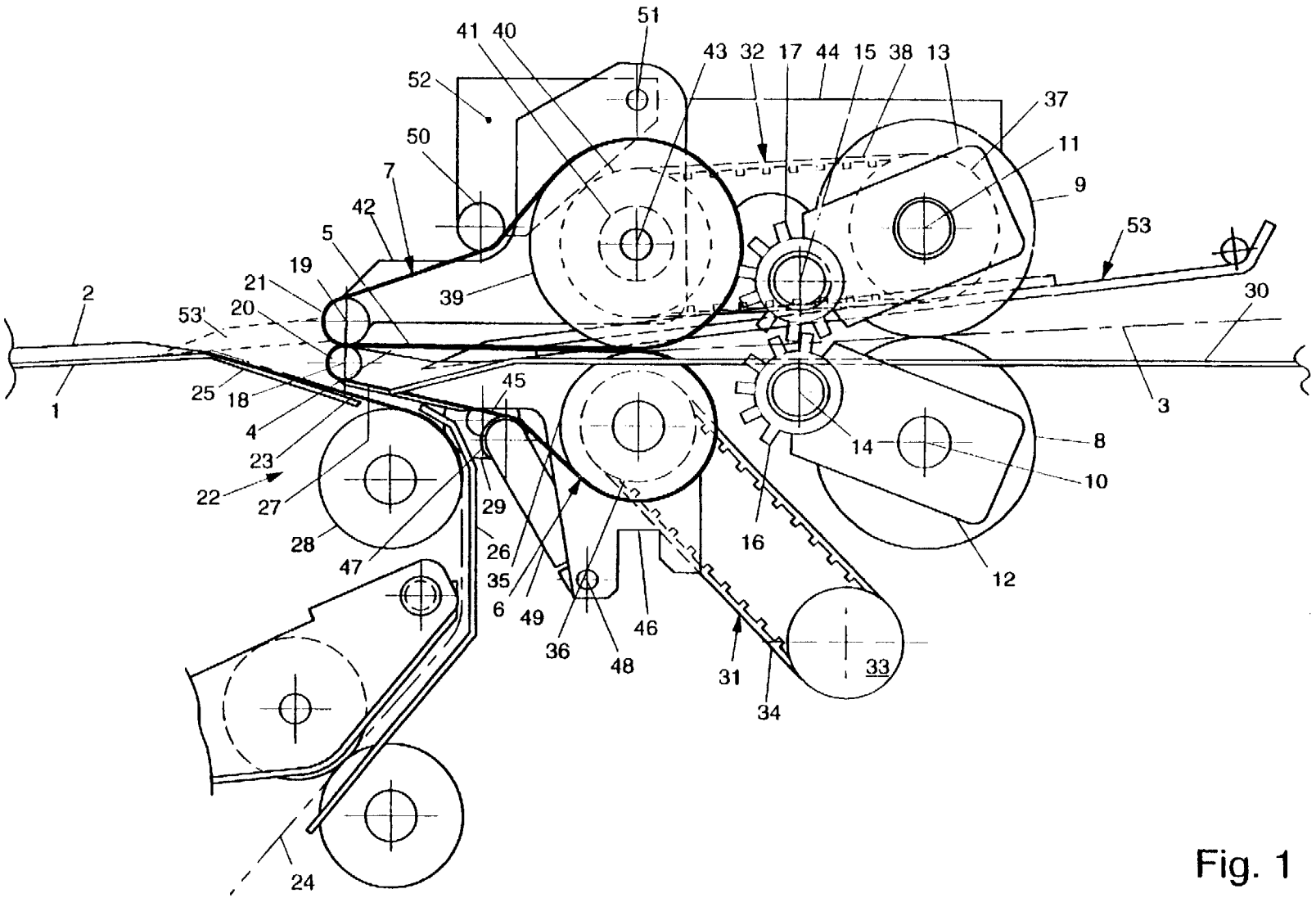

The inserting apparatus shown in the drawing comprises an envelope holder in the form of a supporting table 1. The surface of the supporting table 1 constitutes the reference surface against which each envelope 2 is held prior to and during filling. To save space in the drawing, only a proximal portion of the envelope 2 and of the supporting table 1 is represented.

In the apparatus shown, a document feed path 3 connects to the envelope holder 1. This document feed path is defined by a section 4 of a conveyor belt 6 extending along the path 3 on a first, lower side of the document feed path 3, and an opposite portion of a circulating conveying surface. In the example shown, this portion of the circulating conveying surface is formed by section 5 of a second conveyor belt 7, extending along the document feed path 3, which second conveyor belt section 5 is located opposite the first-mentioned conveyor belt section 4, on a second, upper side of the document feed path 3.

Upstream of the conveyor belt sections 4, 5, the document feed path is defined by a pair of conveyor rollers 8, 9 which are suspended in rockers 12, 13 for rotation about rotation axes 10, 11. These rockers 12, 13 in turn are pivotable about pivots 14, 15 relative to a fixed portion of the apparatus shown. The rockers are provided with meshing teeth 16, 17 which ensure that the rockers are always in approximately mirror-symmetrical positions with respect to the document feed path 3. For a further description of this transport assembly, reference is made to applicant's Dutch patent application 1001828, the content of which is incorporated herein by reference.

In order for the supplied documents to be guided in a substantially planar position, a guide table 30 extends just below the document feed path 3, the width thereof being adapted to the width of the documents to be transported.

The conveyor belt sections 4, 5 are directed towards the envelope holder 1 for conveying to the envelope holder individual or stacked documents to be inserted into an envelope. On the side of the conveyor belt sections 4, 5 proximal to the envelope holder 1, the sections 4, 5 merge into conveyor belt sections 20, 21 which pass over opposite downstream return rollers or pulleys 18, 19. The end of the document feed path 3 on the side of the envelope holder 1 is formed by these transitional portions where the mutually parallel conveyor belt sections 4, 5 merge into the diverging conveyor belt sections 20, 21 which pass over the opposite return pulleys 18, 19.

Further arranged on the lower side of the document feed path 3 is a flap holder 22 for holding in an open position a flap 23 of an envelope 2 waiting in the envelope holder 1. In the apparatus according to the embodiment shown, the flap holder 22 is formed by downstream guides 25, 26, 27 and conveyor rollers 28, 29 which define an envelope feed path 24.

Owing to the feature that the guide located on the lower side of the document feed path 3 closest to the envelope holder 1 is formed by a conveyor belt section which is trained over the most downstream return roller 18 on the lower side of the document feed path 3 (on which side the flap holder 22 is also located), a relatively small, most downstream roller 18 can be used, without this leading to infeed problems. Moreover, the press-on force at the location of the downstream end area of the document feed path 3 can be chosen to be rather high without this causing run-in problems.

The opposite rollers 18, 19 form a nip on the downstream end of the document feed path, which is located very close to the envelope holder, in which nip, in operation, very close to the opening of the envelope large frictional forces can be exerted on the last trailing part of the documents to be inserted, so that these documents are reliably inserted into the envelope.

In principle, the circulating conveying surfaces extending on opposite sides along the document feed path can end on the downstream side of the document feed path at different distances from the envelope holder 1. In the apparatus according to the example shown, however, the roller 19 located opposite the downstream return pulley 18 on the lower side of the document feed path 3 is also an end pulley. Over this end pulley the second conveyor belt 7 is trained.

In order to obtain an optimum advancement of the documents on both sides of the stacks to be inserted, the apparatus according to the example shown is provided with a drive 31 for driving the section 4 of the conveyor belt 6 on the lower side of the document feed path 3 and a drive 32 for driving the opposite portion 5 of the circulating conveying surface which is formed by the circulating conveyor belt 7.

The drive 31 of the conveyor belt 6 on the lower side of the document feed path 3 comprises a transmission gear 33, a toothed belt 34 and a toothed pulley 36 bearing-mounted coaxially with an upstream return pulley 35 over which the conveyor belt 6 is trained. The drive 32 of the conveyor belt 7 on the upper side of the document feed path 3 comprises a transmission gear 37 bearing-mounted coaxially with the conveyor roller 9 on the upper side of the document feed path 3, a toothed belt 38 and a toothed pulley 40 bearing-mounted coaxially with an upstream return pulley 30 over which the conveyor belt 7 is trained.

The drive 31 for driving the conveyor belt 6 on the lower side of the document feed path 3 is adapted for generating a higher peripheral velocity than the other drive 32, which other drive is provided with a freewheel clutch 41. This design of the drives 31, 32 provides the advantage that on the one hand tensional differences between the drives 31, 32, which lead to accelerated wear and moreover can lead to derailing of the conveyor belts 6, 7 are avoided and on the other a lagging document on the upper side of a stack is forced to move at least as fast as the peripheral velocity of the conveyor belt 7 on the upper side of the document feed path 3. It is noted that the above-mentioned effects can also be achieved by designing the drives 31, 32 in such a manner that the circulating conveying surface on the upper side of the document feed path 3 travels faster than the peripheral velocity of the conveyor belt 6 on the lower side of the document feed path 3 and equipping the drive on the lower side of the document feed path 3 with a freewheel clutch.

In order to limit the extent to which a lagging document can lag relative to the other documents in the stack, the drives 31, 32 are so designed that in operation the difference between driven peripheral velocities is less than 10% and preferably 0.5 to 1.0%.

If the drives on both sides of the document feed path are each equipped with a freewheel clutch, it is also possible to drive the conveying surfaces on opposite sides of the document feed path with the same nominal peripheral velocity. This provides the advantage that documents on opposite sides of each stack of supplied documents, apart from the differences in speed between the circulating surfaces on opposite sides of the document feed path 3 caused by tolerances, are advanced at the same speed.

The circulating conveying belt 7 on the upper side of the document feed path 3 forms part of a belt conveyor which further consists inter alia of a support 42 and the return pulleys 19, 39 mentioned earlier, which are bearing-mounted relative to the support 42. The support 42 is suspended from a rocker 44 for pivoting motion about a first pivot 42, the rocker 44 being adapted to pivot about a second pivot 11 (this is also the rotation axis of the conveyor rollers 9 on the upper side of the document feed path) spaced from the first pivot. As a result, the section 5 of the conveyor belt 7 passing along the document feed path 3 can easily adjust to passing sets of documents of different thicknesses. The movability of the support 42 of the belt conveyor obtained by virtue of the suspension with the intermediate rocker 44 further provides the advantage that this belt conveyor can easily be displaced for the purpose of rendering the document feed path 3 accessible for cleaning, maintenance, repairs, or removing any jammed documents.

Owing to one of the rollers 19, 39 being arranged coaxially with the first pivot 43 and being coupled with a transmission gear 37 which is arranged coaxially with the second pivot 11, in spite of the movability of the belt conveyor, yet a drive of this belt conveyor has been effected in a simple manner.

The conveyor belt 6 on the lower side of the document feed path 3 has a return conveyor belt section 45, projecting from the return pulley 18, on the side of the conveyor belt 6 remote from the document feed path 3. Some of the guides 27 of the flap holder 22 are located adjacent to and, at least partly, on the side of the return conveyor belt section 45 remote from the document feed path 3. These guides prevent the possibility that a supplied envelope or the flap 23 of an envelope 2 disposed in the envelope holder 1 comes into contact with this return conveyor belt section 45 which in operation moves counter to the feeding direction of the envelopes.

These guides 27 are designed as flanges projecting with respect to the return conveyor belt section 45 towards the envelope feed path 24. As a result, it is not necessary to arrange between the envelope feed path 24 and the return conveyor belt section 45 a guide with a wall thickness and the required amounts of play. This saves space between the envelope feed path 24 and the return conveyor belt section 45. As a consequence, the end pulley 18 can be placed very close to the envelope feed path 24 and hence in a position which in operation is very close to the envelope 2 to be filled. Instead of several guides, optionally a single guide can be used in view of the stiffness of the envelopes supplied in curved position.

Owing to the flange 27 also forming part of a supporting structure 46 in which the return pulley 18 is bearing-mounted, positioning problems through tolerances at the position of the conveyor belt 6 relative to the other guides and rollers of the envelope feed path 24 are prevented.

Engaging the external surface of the return conveyor belt section 45 is a tensioning roller 47 for tensioning the conveyor belt 6. This tensioning roller 47 is bearing-mounted in a rocker 49 adapted to pivot about a pivot 48. This position of the tensioning roller provides the advantage that the return conveyor belt section 45 is urged away from the envelope feed path 24, thereby providing space for having the envelope feed path 24 connect to the envelope holder 1 via a gentle curve.

For tensioning the conveyor belt 7 on the upper side of the document feed path 3, the apparatus comprises a tensioning roller 50 which is bearing-mounted in a rocker 52 suspended for pivoting movement about a pivot 51.

For opening the envelope 2 and for holding open the envelope 2 during the insertion of documents, the apparatus comprises an opener assembly 53 reciprocally movable approximately parallel to the conveying path, which assembly 53 is reciprocally movable between the position depicted and a second position. The position in the second condition of the end 53' of the opener assembly 53 on the side of the envelope holder is indicated by chain-dotted lines.

Wetting and closing and discharging filled envelopes can be carried out in a conventional manner, known per se, and with conventional means, known per se. These operations and the provisions for carrying out those operations are therefore not described in this application. For a further description of the supply, the filling, the closure and the discharge of envelopes, reference is made to a Dutch patent application in applicant's name, filed simultaneously with the present application, entitled "Apparatus and method for inserting documents into an envelope", the content of which is incorporated herein by reference. It is noted that on the basis of the insights set out hereinabove, many possibilities within the scope of the present invention other than the examples described hereinabove have been brought within reach of those skilled in the art. For instance, the first side of the document feed path, on which side the flap holder is located, can constitute, rather than the lower side, the upper side of the document feed path, as is typically the case with inserting apparatuses in which envelopes are supplied from above and documents are inserted in a face-up position into the envelope held in readiness. The circulating conveying surface on the second side of the document feed path, rather than being designed as the outer circumference of a conveyor belt, can also be designed as the circumferential surface of a conveyor roller. Preferably, several conveyor belts and conveying rollers side by side should be used in order to distribute the frictional forces in the width direction across the supplied documents. It is also possible, however, to use single conveyor belts and rollers. It is then preferred, however, to make them of broad design.

We claim:

1. An inserting apparatus comprising:

an envelope holder for holding an envelope in or against a particular surface, a flap holder for holding in an open position a flap of an envelope being held in the envelope holder, and a document feed path, of which most downstream operative transport elements are formed by an extreme downstream conveyor roller on a first side of the document feed path proximal to the flap holder, which also constitutes the extreme downstream guide on the first side of the document feed path proximal to the flap holder, and an opposite, circulating conveying element, defining a nip together with said downstream conveyor roller, which constitutes the extreme downstream conveying element on a second side of the document feed path, wherein said extreme downstream roller on said first side of the document feed path is designed as a downstream return pulley of a circulating conveyor belt.

2. An apparatus according to claim 1, wherein diametrically opposite said extreme downstream return pulley on said first side of the document feed path, a conveyor roller is located which defines a nip together with said return pulley.

3. An apparatus according to claim 1, further comprising a drive for driving said conveyor belt section and a drive for driving said opposite, circulating conveying surface, one of said drives being arranged for generating a higher peripheral velocity than the other of said drives, which other of said drives comprises a freewheel clutch.

4. An apparatus according to claim 3, wherein the drives are so designed that in operation the difference between the peripheral velocities of said conveyor belt section and said opposite, circulating conveying surface is less than 10%.

5. An apparatus according to claim 1, further comprising a drive for driving said conveyor belt section and a drive for driving said opposite, circulating conveying surface, said drives being each equipped with a freewheel clutch and being arranged for operatively driving said conveyor belt section and said opposite, circulating conveying surface at identical nominal peripheral velocities.

6. An apparatus according to claim 1, wherein a belt conveyor along the document feed path comprises a support, at least two rollers bearing-mounted with respect to that support, and a belt trained over those rollers, with the support being suspended for pivoting movement about a first pivoting axis relative to a rocker pivotable about a second pivoting axis spaced from the first pivoting axis.

7. An apparatus according to claim 6, wherein one of the rollers of said belt conveyor is arranged coaxially with said first pivoting axis and is coupled with a transmission gear arranged coaxially with said second pivoting axis.

8. An apparatus according to claim 1, wherein the conveyor belt section on said first side of the document feed path forms part of a conveyor belt which further has, on its side remote from the document feed path, a return conveyor belt section projecting from the return pulley, and wherein the flap holder is provided with a guide adjacent said return conveyor belt section, which guide is at least partly located on the side of said return conveyor belt section remote from the document feed path.

9. An apparatus according to claim 8, wherein the guide is designed as a flange projecting from said return conveyor belt section.

10. An apparatus according to claim 9, wherein the flange projects from a supporting structure in which the return pulley is bearing-mounted.

11. An apparatus according to claim 8, wherein a tensioning roller engages an external surface of the return conveyor belt section.

* * * * *